US008820974B2

(12) United States Patent
Chang et al.

(10) Patent No.: US 8,820,974 B2
(45) Date of Patent: Sep. 2, 2014

(54) LIGHT-EMITTING-DIODE (LED) LIGHT BULB

(75) Inventors: Liann-Be Chang, Tao-Yuan (TW); Chia-Yi Yen, Tao-Yuan (TW)

(73) Assignee: Chang Gung University, Tao-Yuan (TW)

( * ) Notice: Subject to any disclaimer, the term of this patent is extended or adjusted under 35 U.S.C. 154(b) by 71 days.

(21) Appl. No.: 13/420,794

(22) Filed: Mar. 15, 2012

(65) Prior Publication Data

US 2012/0236569 A1 Sep. 20, 2012

(30) Foreign Application Priority Data

Mar. 18, 2011 (TW) ..... 100109445 A

(51) Int. Cl.
*F21V 29/00* (2006.01)

(52) U.S. Cl.
USPC .. 362/294; 362/249.02; 362/650; 362/311.02

(58) Field of Classification Search
USPC ..... 362/294, 650, 410, 412
See application file for complete search history.

(56) References Cited

U.S. PATENT DOCUMENTS

| | | | | |
|---|---|---|---|---|
| 7,226,189 | B2 * | 6/2007 | Lee et al. | 362/294 |
| 2005/0162864 | A1 * | 7/2005 | Verdes et al. | 362/555 |
| 2007/0258251 | A1 * | 11/2007 | Lin | 362/410 |
| 2010/0067240 | A1 * | 3/2010 | Selverian et al. | 362/350 |
| 2011/0216540 | A1 * | 9/2011 | McCafferty, Jr. | 362/282 |
| 2012/0014116 | A1 * | 1/2012 | Hu | 362/335 |

* cited by examiner

*Primary Examiner* — Evan Dzierzynski
(74) *Attorney, Agent, or Firm* — Rosenberg, Klein & Lee

(57) ABSTRACT

An LED light bulb, mainly comprising: an LED module, provided with a first connection portion; a circuit driving module, provided with a second connection portion, said first connection portion is connected to said second connection portion; and a lamp hood covered over said LED module. As such, said LED module or said circuit driving module can be replaced readily when they are found broken down, without the need to discard entire set of LED light bulb, hereby eliminating unnecessary waste, in achieving both cost effectiveness and environment protection.

12 Claims, 6 Drawing Sheets

LIGHT-EMITTING-DIODE (LED) LIGHT BULB

BACKGROUND OF THE INVENTION

1. Field of the Invention

The present invention relates to an LED light bulb, and in particular to an LED light bulb, for which the LED chips or electronic components can be replaced as required.

2. The Prior Arts

Along with the rapid depletion of energy resources, presently, the subject of how to maintain our living standard, and to achieve progress in science and technology while reducing energy consumption, has become an urgent issue for the Industries.

In this respect, and regard to lighting, light-emitting-diode (LED) has quite a lot of advantages due to its optical characteristics, such as, long service life, low power consumption, free of noise, ultra-violet radiation, and fire-proof for being a cool light source, so that replacing the existing lighting devices with the LED lighting devices has become an irreversible trend.

Presently, the LED light bulb available on the market includes: a lamp head, a lamp hood, a substrate, LED chips, and a driving circuit provided on the substrate. The lamp head and LED chip are connected electrically to the driving circuit. The lamp hood is installed and fixed on top of the substrate, to cover over the LED chips. When the LED chip is activated to proceed with lighting, the light produced by LED chips is able to transmit through the lamp hood in achieving illumination. However, in this configuration, in case the LED chips or the driving circuit breaks down, the entire LED light bulb has to be replaced in causing unnecessary waste.

Therefore, presently, the structure and performance of LED light bulb are not quite satisfactory, and it has much room for improvements.

SUMMARY OF THE INVENTION

In view of the problems and drawbacks of the prior art, the present invention provides an LED light bulb, so as to overcome the shortcomings of the prior art.

A major objective of the present invention is to provide an LED light bulb, wherein, the LED chips or electronic components can be replaced when they break down, without having to discard the whole set of LED light bulb, thus eliminating the unnecessary waste, in achieving cost-effectiveness and environment protection.

Another objective of the present invention is to provide an LED light bulb, that is applicable in a table lamp, to simplify the overall structure of the table lamp.

In order to achieve the above-mentioned objective, the present invention provides an LED light bulb, mainly comprising: an LED module, provided with a first connection portion; a circuit driving module, provided with a second connection portion, the first connection portion is connected to the second connection portion; and a lamp hood covered over the LED module.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from this detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed descriptions with reference to the attached drawings.

The present invention provides an LED light bulb, mainly comprising: an LED module, provided with a first connection portion; a circuit driving module, provided with a second connection portion, the first connection portion is connected to the second connection portion; and a lamp hood, covered over the LED module. Through the application of the present invention, the LED module or circuit driving module can be replaced as required, without having to discard the whole LED light bulb, thus reducing the unnecessary waste, in achieving cost effectiveness and environment protection.

In the following, an embodiment of the present invention is described.

Figure 1:
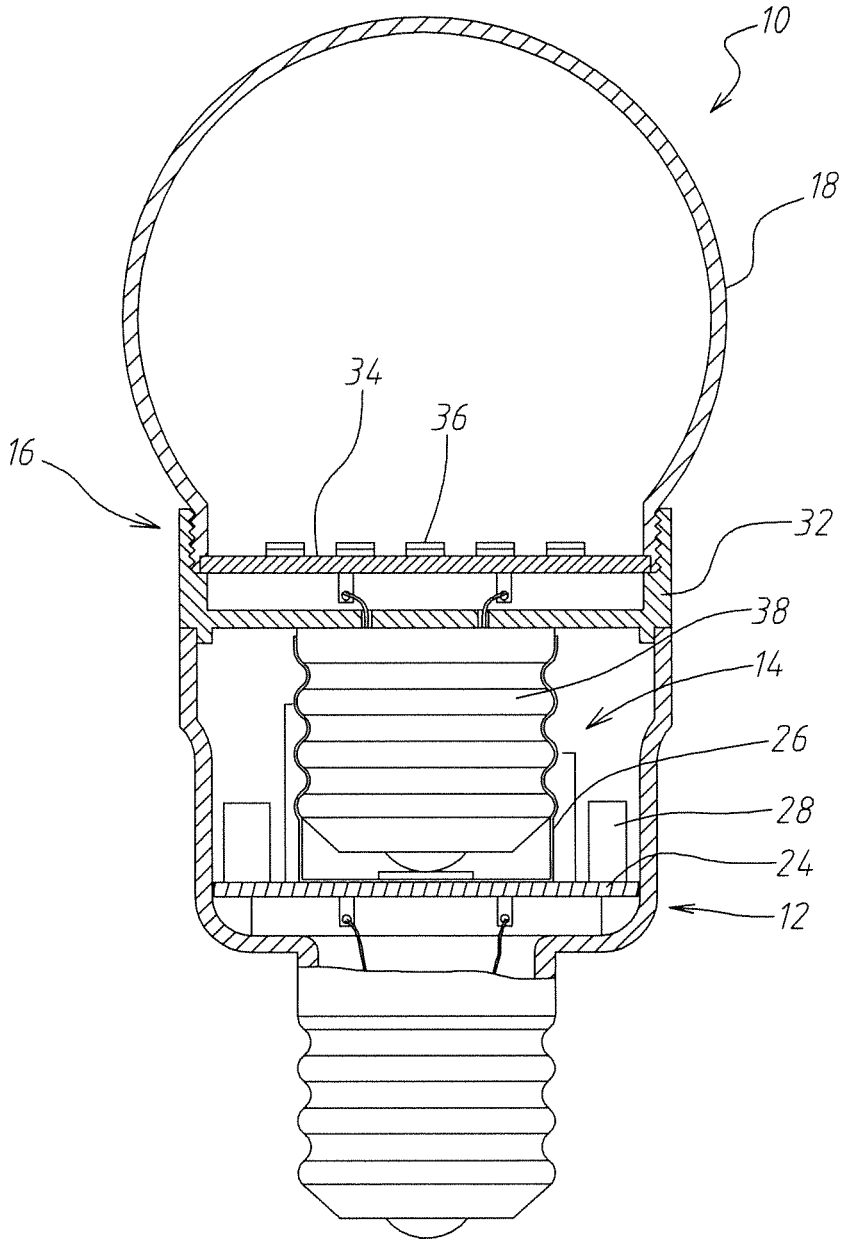
FIG. 1 is a schematic diagram of an LED light bulb according to the present invention.
Figure 2:
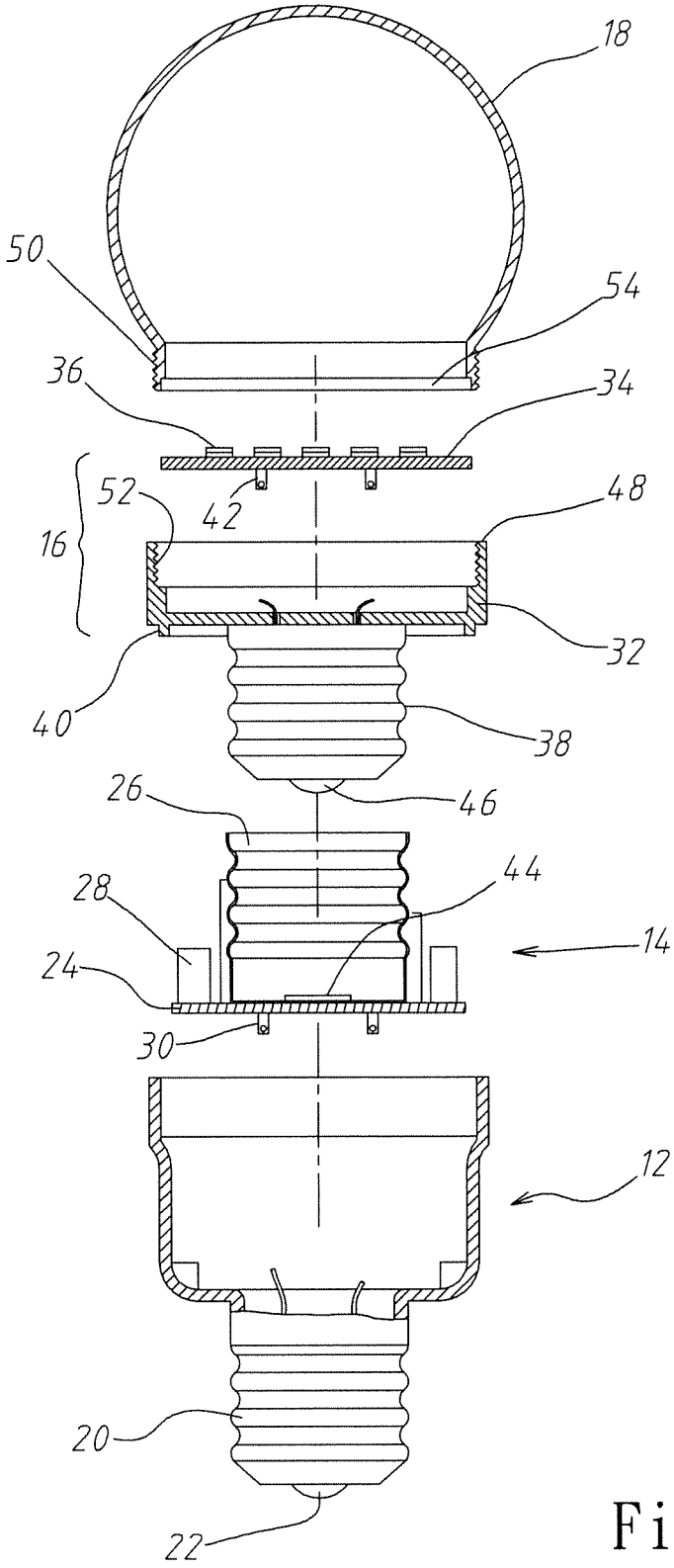
FIG. 2 is an exploded view of components of an LED light bulb according to the present invention.
Figure 3:
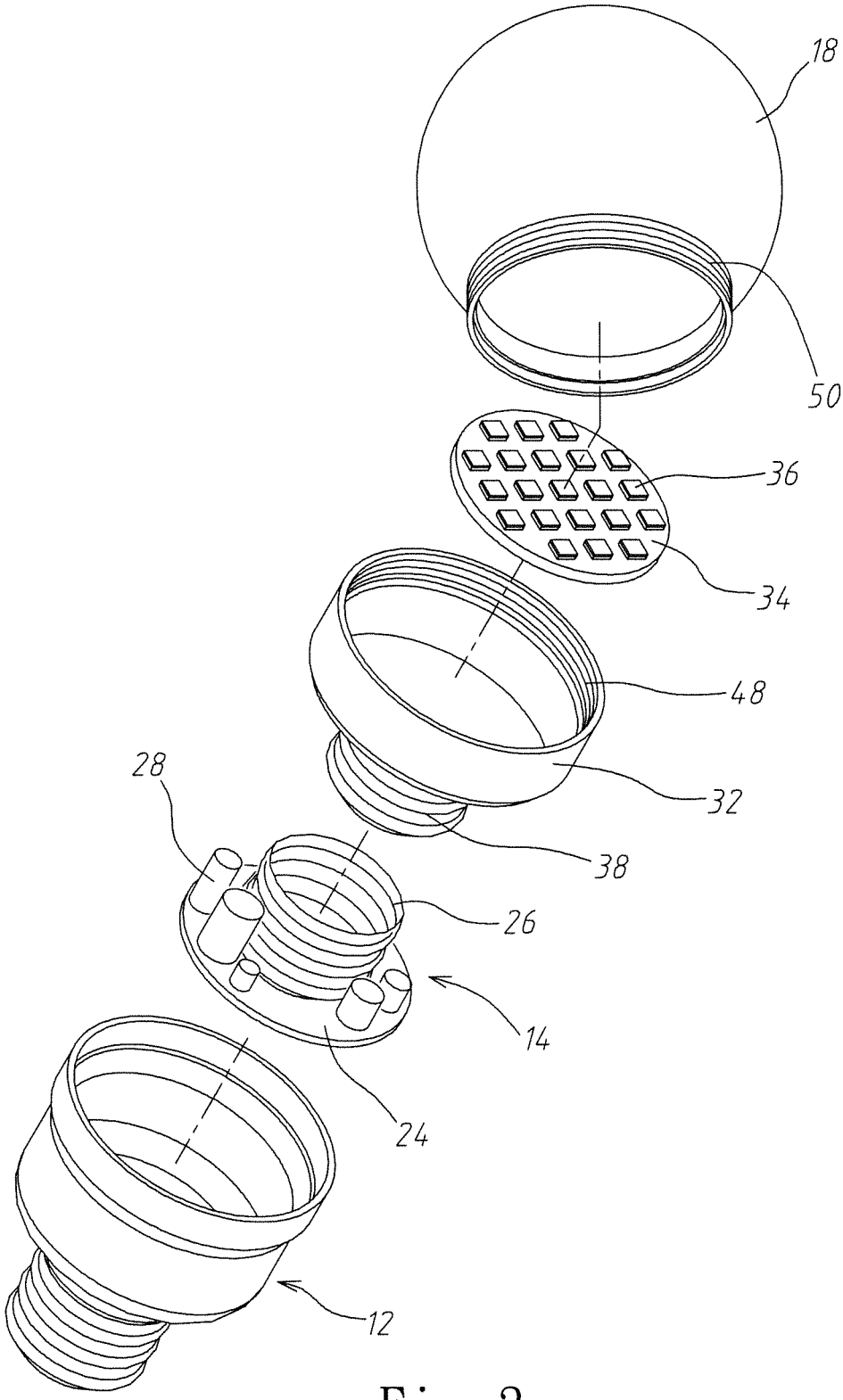
FIG. 3 is an exploded and perspective view of components of an LED light bulb according to the present invention.

Refer to FIGS. 1, 2, and 3 respectively for a schematic diagram of an LED light bulb according to the present invention; an exploded view of components of an LED light bulb according to the present invention; and an exploded and perspective view of components of an LED light bulb according to the present invention. As shown in FIGS. 1,2, and 3, the LED light bulb 10 of the present invention mainly includes a cup-shaped lamp head 12, a circuit driving module 14, an LED module 16, and a lamp hood 18.

In the descriptions mentioned above, the bottom of the cup-shaped lamp head 12 is provided with a power connector 20. The power connector 20 can be of an existing light bulb screw-connection head structure, is a screw-connection head having external threads and with its bottom provided with a first electric connection point 22. The external threads located around the perimeter of the screw-connection head is another electric connection point. The two electric connection points constitute the positive input terminal and negative input terminal of the power supply of the light bulb.

The circuit driving module 14 is provided and received in the cup-shaped lamp head 12, and the circuit driving module 14 includes: a first electric circuit board 24; a female screw-connection portion 26, to serve as a second connection portion; and the at least an electronic component 28 provided on the first electric circuit board 24 and around the outer perimeter of the female screw-connection portion 26. The first electric circuit board 24 is connected electrically to the power connector 20, namely, as shown in the drawing, the bottom of the first electric circuit board 24 is provided with two electric connection points 30, connected electrically to the power connector 20.

The LED module 16 mainly includes: a vessel-shaped main body 32, a second electric circuit board 34, and at least an LED chip 36 disposed on a second electric circuit board 34. The bottom surface of the vessel-shaped main body 32 is provided with a male screw-connection portion 38 corresponding to the female screw-connection portion 26, and is used as the fist connection portion. The bottom of the vessel-shaped main body 32 is connected to the top of the cup-shaped lamp head 12. Herein, the connection can be realized in any ways familiar to the people of this technology. By way of example, as shown in the drawing, the bottom of the vessel-shaped main body 32 can be provided with an insertion slot 40, for the insertion of the cup-shaped lamp head 12. The second electric circuit board 34 is received in the vessel-shaped main body 32, and is connected electrically to the male screw-connection portion 38. Herein, the connection is as shown in the drawing, the bottom of the second electric circuit board 34 is provided with two electric connection points 42, for connecting electrically to the male screw-connection portion 38.

Inside the female screw-connection portion 26 is provided with a second electric connection point 44, and the male screw-connection portion 38 is provided with a third electric connection point 46 corresponding to the second electric connection point 44, to provide conduction when the two portions are connected, without the need to use wiring connections.

The bottom end of the lamp hood 18 is connected to the front end of the vessel-shaped main body 32, to cover over the LED module 16. Herein, the connection can be realized in any way familiar to the people of this technology. By way of example, as shown in the drawing, the inner wall of the front end of the vessel-shaped main body 32 is provided with a first thread 48, and the outside wall of the bottom of the lamp hood 18 is provided with a second thread 50. Through the screw-connection of the first thread 48 and the second thread 50, the lamp hood 18 is connected to the vessel-shaped main body 32.

Moreover, the inner surface of the vessel-shaped main body 32 is provided with a positioning ring 52 in protrusion, and the inner surface of the lamp hood is provided with a receiving slot 54, so that when the bottom end of the lamp hood 18 is connected to the front end of the vessel-shaped main body 32, the second electric circuit board 34 is received in the receiving slot 54, and is against the positioning ring 52, to form secure positioning.

Furthermore, to enhance the heat dissipation of the LED light bulb, the cup-shaped lamp head 12 can be provided with a plurality of first heat dissipation fins (not shown), and the outer perimeter of the vessel-shaped main body 32 can be provided with a plurality of the second heat dissipation fins (not shown).

Figure 4:
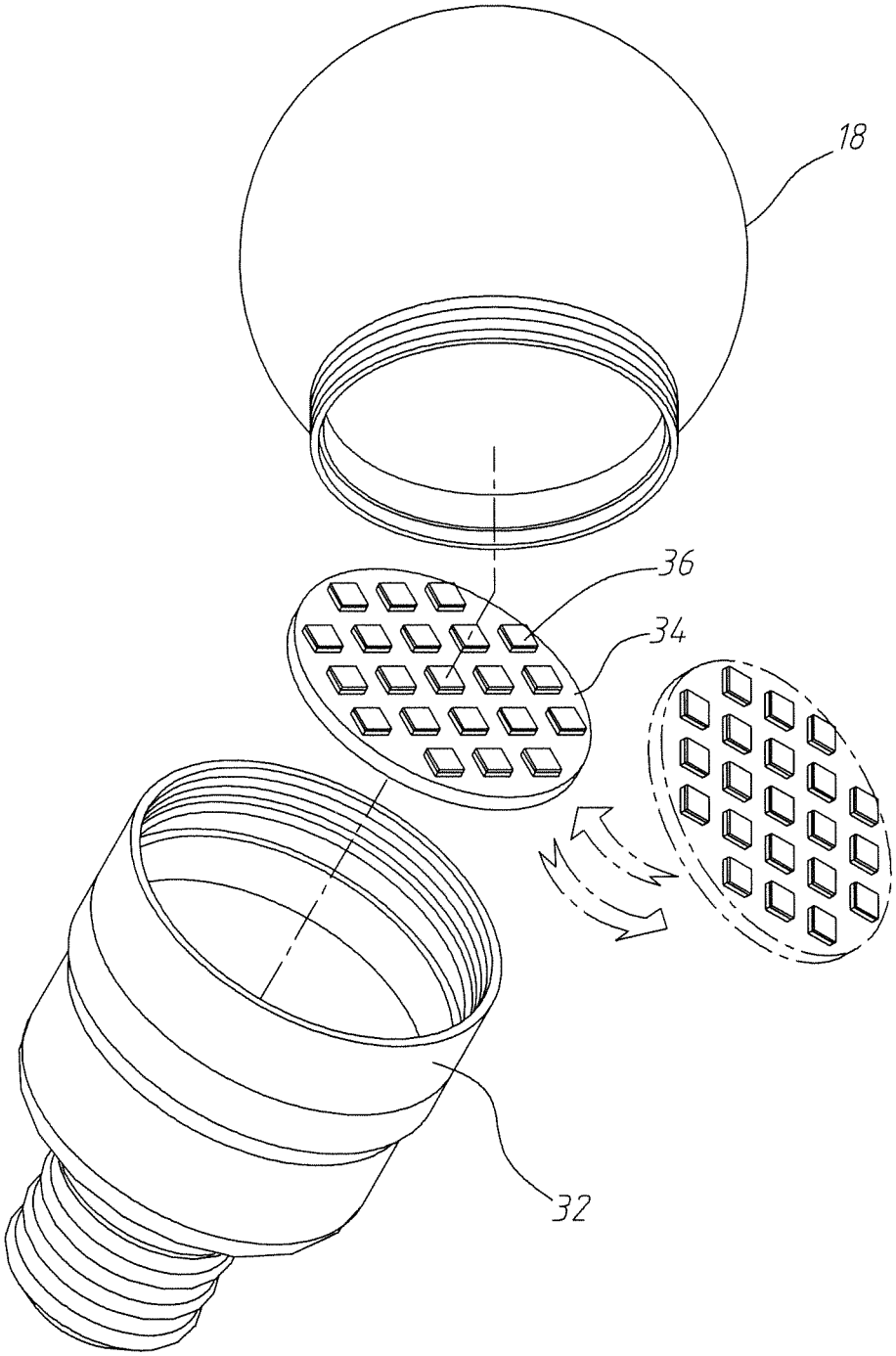
FIG. 4 is a schematic diagram of replacing the second electric circuit board having LED chips thereon, when the LED chips in the LED light bulbs break down, by detaching the lamp hood and the vessel-shaped main body according to the present invention.
Figure 5:
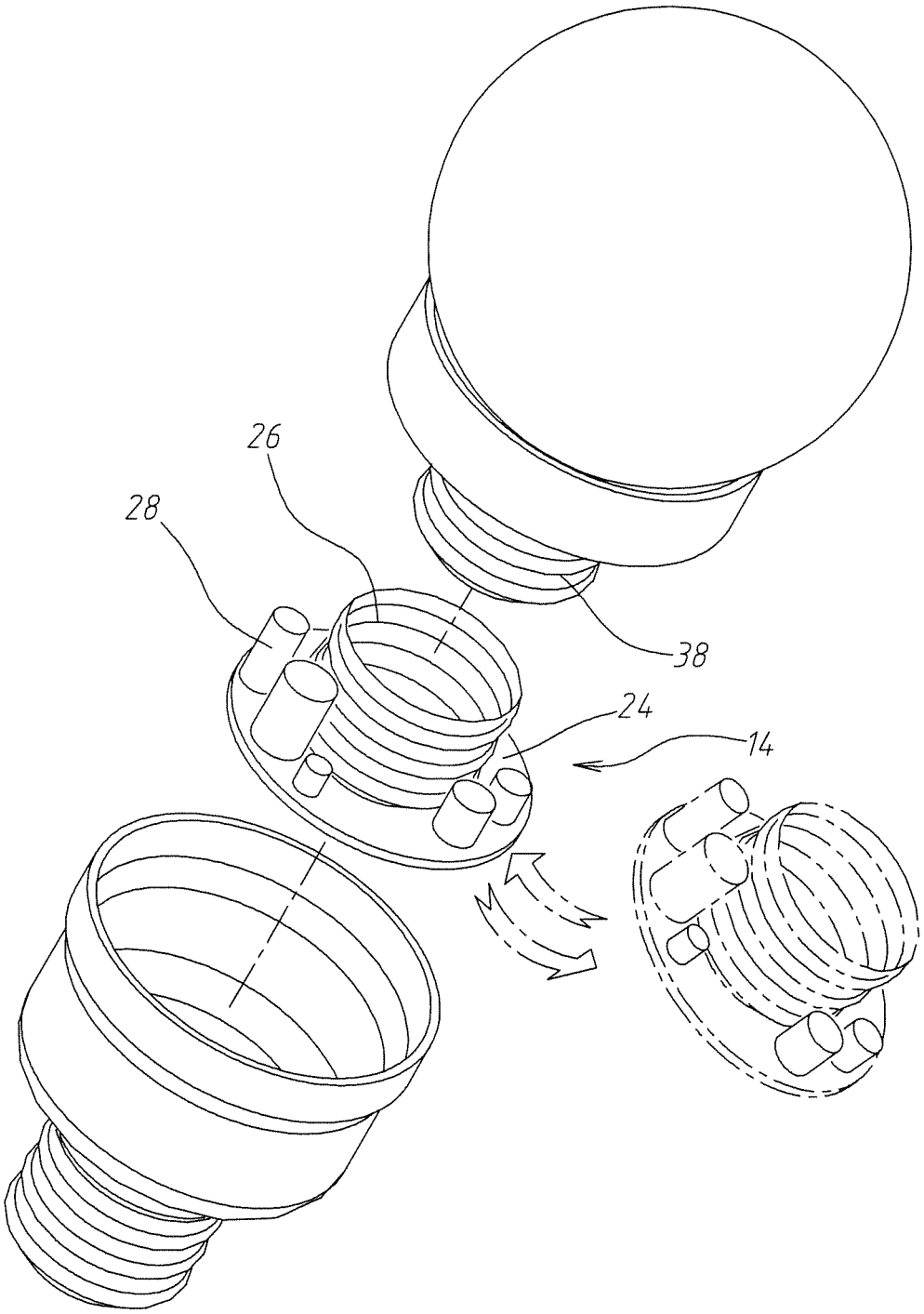
FIG. 5 is a schematic diagram of replacing the circuit driving module, when the electronic components in the LED light bulbs break down, by detaching a male screw-connection portion and the female screw-connection portion according to the present invention.

In the structure of the LED light bulb, as shown in FIG. 4, when the LED chips 36 breaks down, the second electric circuit board 34 having LED chips 36 thereon can be replaced by detaching the lamp hood 18 and the vessel-shaped main body 32. Also, as shown in FIG. 5, when it is determined that the electronic components 28 are broken down, the circuit driving module 14 can be taken out for replacement through detaching the male screw-connection portion 38 and the female screw-connection portion 26. As such, the LED chips 36 or electronic components 28 can be replaced readily when they are found broken down, without the need to discard the entire set of LED light bulb, hereby eliminating unnecessary waste, in achieving both cost effectiveness and environment protection.

In addition, since the surface temperature of the lamp hood of LED light bulb is lower, and it could not have the high temperature of the conventional tungsten filament light bulb, therefore, it can be used in a table lamp, to simplify its overall structure.

Moreover, the cup-shaped lamp head 12 can be a female light bulb base on a lamp base.

Furthermore, the circuit driving module 14 mentioned above can be connected directly to a lamp power base (not shown), and a power regulating piece is attached to the lamp power base, to regulate and obtain directly various powers required by the LED module. Therefore, when replacing LED light bulbs of different power, only the LED module 16 has to be replaced, and there is no need to replace the entire set of light bulb.

Figure 6:
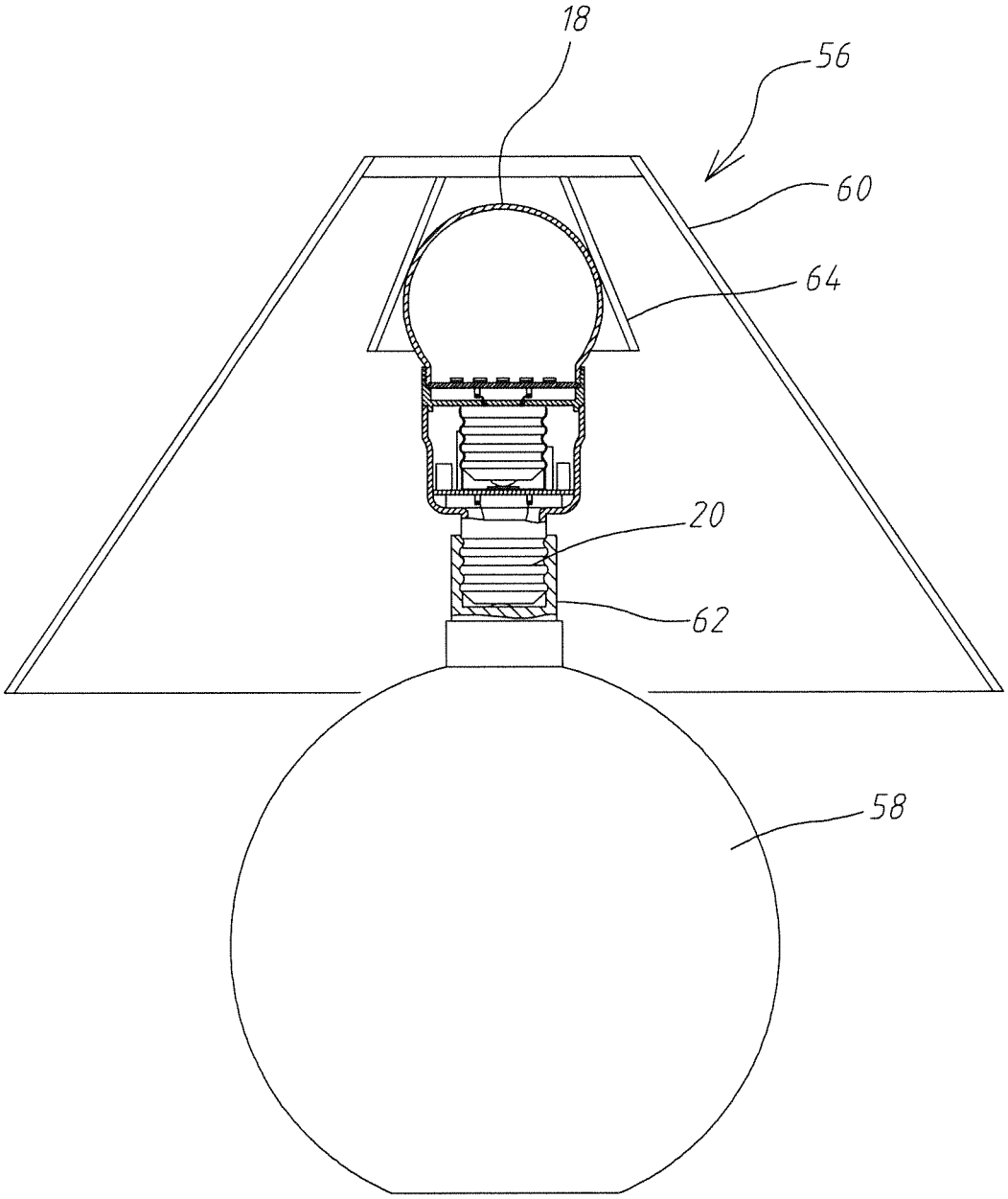
FIG. 6 is a schematic diagram of a table lamp having an LED light bulb installed according to the present invention.

Refer to FIG. 6 for a schematic diagram of a table lamp having an LED light bulb installed according to the present invention. As shown in FIG. 6, the table lamp 56 mainly comprises: a lamp base 58, an LED light bulb 10, and a cone-shaped lamp hood 60. A female light bulb base 62 is provided over the lamp base 58 for the connection of the power connector 20. A mounting frame 64 is provided at the small diameter end of the cone-shaped lamp hood 60, to sleeve directly onto the lamp hood 18 of the LED light bulb 10, so that light is reflected to the large diameter end of the cone-shaped lamp hood 60. As such, there is no need of an additional positioning frame of complicated structure between lamp base and lamp hood as in the prior art.

Finally, the inner surface of the lamp hood 60 can be coated with a reflection layer (not shown), to reflect the lights of the LED light bulb.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. An LED light bulb, comprising:

an LED module, provided with a first connection portion;

a circuit driving module, provided with a second connection portion, said first connection portion is connected to said second connection portion; and a lamp hood, covered over said LED module;

wherein said LED module includes:

a vessel-shaped main body, with its bottom provided with said first connection portion;

a second electric circuit board, provided in said vessel-shaped main body; and at least an LED chip, provided on said second electric circuit board; and wherein inner surface of said vessel-shaped main body is provided with a positioning ring in protrusion, and inner surface of said lamp hood is provided with a receiving slot, so that when said bottom end of said lamp hood is connected to said front end of said vessel-shaped main body, said second electric circuit board is received in said receiving slot, and is against said positioning ring.

2. The LED light bulb as claimed in claim 1, wherein said circuit driving module includes:

a first electric circuit board, on which is provided with said second connection portion; and at least an electronic component, disposed on said first electric circuit board and around outer perimeter of said second connection portion.

3. The LED light bulb as claimed in claim 1, wherein inside wall of front end of said vessel-shaped main body is provided with a first thread, and bottom end of said lamp hood is provided with a second thread, to engage said first thread.

4. The LED light bulb as claimed in claim 1, wherein outer shell of said vessel-shaped main body is provided with a plurality of second heat dissipation fins.

5. The LED light bulb as claimed in claim 1, further comprising:

a lamp power base, provided with said circuit driving module and a power regulating piece, and said power regulating piece is to regulate power of said LED circuit driving components.

6. The LED light bulb as claimed in claim 1, further comprising:

a cup-shaped lamp head, with its bottom provided with a power connector, said cup-shaped lamp head is used to receive said circuit driving module.

7. The LED light bulb as claimed in claim 6, wherein said power connector is provided with a screw-connection head having outer threads, and with its bottom provided with a first electric connection point.

8. The LED light bulb as claimed in claim 6, wherein outer shell of said cup-shaped lamp head is provided with a plurality of first heat dissipation fins.

9. The LED light bulb as claimed in claim 6, wherein said cup-shaped lamp head is a female light bulb base located on a lamp base.

10. The LED light bulb as claimed in claim 1, installed on a table lamp, said table lamp includes:

a lamp base, on which is provided with said female light bulb base, for placing and connecting said LED light bulb; and a lamp hood, having a positioning frame provided inside, for sleeving onto said lamp hood.

11. The LED light bulb as claimed in claim 10, wherein inner surface of said lamp hood is coated with a reflection layer, to reflect light of said LED light bulb.

12. The LED light bulb as claimed in claim 1, wherein inside said second connection portion is provided with a second electric connection point, and said first connection portion is provided with a third electric connection point corresponding to said second electric connection point.

* * * * *